United States Patent [19]

Collins

[11] Patent Number: 4,766,291

[45] Date of Patent: Aug. 23, 1988

[54] ELECTRICAL HEATING ELEMENT MODULE FOR HAIR COMB OR PICK

[76] Inventor: Virgil H. Collins, 958 Sunbury, Columbus, Ohio 43219

[21] Appl. No.: 845,452

[22] Filed: Mar. 28, 1986

[51] Int. Cl.[4] ..... H05B 3/00; A45D 20/48; H01C 1/028

[52] U.S. Cl. ..... 219/534; 132/118; 219/222; 219/237; 219/537; 219/539; 219/541; 219/544; 338/243; 338/268; 338/302

[58] Field of Search ..... 219/222–226, 219/236, 237, 544, 534, 541, 537, 539; 338/243–248, 296, 302, 267, 268; 132/117, 118

[56] References Cited

U.S. PATENT DOCUMENTS

| | | | |
|---|---|---|---|
| 1,034,859 | 8/1912 | Anderson | 132/118 |
| 1,056,987 | 3/1913 | Gough | 219/222 X |
| 1,210,018 | 12/1916 | Trood | 219/222 X |
| 1,530,352 | 3/1925 | Cook | 219/225 X |
| 1,536,669 | 5/1925 | Grant | 132/118 |
| 1,553,342 | 9/1925 | Vaughan | 338/268 X |
| 2,167,389 | 7/1939 | Kuhn et al. | 219/237 X |
| 3,760,821 | 9/1973 | Weddington | 219/222 X |

FOREIGN PATENT DOCUMENTS

| | | | |
|---|---|---|---|
| 496332 | 7/1954 | Italy | 132/118 |
| 6436 | of 1896 | United Kingdom | 219/222 |
| 6188 | of 1899 | United Kingdom | 219/225 |

*Primary Examiner*—Anthony Bartis
*Attorney, Agent, or Firm*—Anthony Cennamo

[57] ABSTRACT

An electrical heating element module particularly useful for heating the teeth of a hair comb or pick includes a pair of parallel, side-by-side spaced elongated central conductors having wound thereon a fibrous inorganic electrical insulation material, such as glass yarn, with the opposite ends of each central conductor exposed. An electrical resistance heater wire is wound over the glass insulation yarn on one central conductor and then over the yarn of the other central conductor and making contact with a corresponding end of each central conductor thereby providing effectively one electrical resistance heater. The central conductors are vertically supported by a flat insulator having a pair of sockets provided with spring contacts for establishing electrical connection to the remaining exposed ends of the central conductors. Each insulated central conductor and heater wire thereon is surrounded by a separate tubular non-fibrous insulation sheath, which in turn is enclosed by a separate tubular metallic sheath adapted to form the exterior surface of a comb tooth.

6 Claims, 4 Drawing Sheets

ELECTRICAL HEATING ELEMENT MODULE FOR HAIR COMB OR PICK

BACKGROUND OF THE INVENTION

This invention relates to a modular electrical resistance heating element and particularly relates to a hair comb or pick for most effectively utilizing the heating element of the present invention.

Heating hair combing instruments have been suggested in the past because of their usefulness in drying, curling or straightening hair fibers for cosmetic purposes. Electrically heated hair combing instruments have, in general, been of two basic types.

In some cases, such as shown in U.S. Pat. Nos. 2,648,757 and 3,742,964, the backbone of the comb or the handle of the comb is heated and the heat is transferred into the teeth by thermal conduction. Others have devised hair combing instruments such as those shown in U.S. Pat. No. 1,034,859 and 3,760,821, which extends individual resistance heating elements into each comb tooth.

The first example which calls for heating the backbone of the comb and allowing the heat to be transfered to the teeth by conduction has proved to be impractical for a comb needed for grooming the hair. The concentrated heat at the backbone of the comb must be a high temperature in order for enough heat to conduct to the teeth and be effective. This provides for an unbalanced temperature condition making the backbone of the comb a high temperature and the teeth at a lower temperature.

When the teeth are made hot enough to groom or straighten the hair, the backbone is at a sufficiently higher temperature and will occasionally burn and damage the hair.

The heat rise time is also very slow because of the large mass of metal the heating element is required to heat. This product is therefore impractical for everyday hair grooming. It is therefore apparent that the heat should be applied directly to the teeth to be effective.

The second example, which calls for installing heating elements into each tooth of a comb or pick by looping one continuous element into each tooth, has also proven impractical. For a hair combing instrument to be an effective tool for combing the hair, the teeth must be narrow or approximately 0.094 inch O.D. or less.

The amount of heat needed in hair grooming is relatively low, so heaters used in the application of hair combs must have the ability to transfer and dissipate heat very rapidly without damaging the hair. Present patents on resistance heating elements such as shown in U.S. Pat. Nos. 4,112,410 and 1,553,342 suggest that an insulative material such as a fibrous, inorganic insulation material or a dry powdered electrical insulator be installed between the heating element and the other sheath and then the unit is swaged down to provide for maximum heat transfer.

Due to the fact that the heating element is embodied with the insulation material between the heater and the outer sheath, and the outer sheath is swaged down onto the insulation, this constitutes for a maximum heat transfer in those type heating elements. However, because the heater wire must raise the temperature of everything in direct contact with it or embodying it, the temperature rise time is relatively slow for the inclosed heating element.

Therefore the outer sheath will be slow in reaching operating temperature and the heat will quickly dissipate when the outer sheath surface is cooled by passing the teeth through a substance such as hair fibers.

The electrical energy needed for converting to heat is relatively low for hair grooming, so therefore the previously mentioned heating element will cause the finished product to have either a slow heat transfer rate and a high dissipation rate or if more energy is applied, it will cause the unit to get too hot for hair grooming purposes.

Therefore there is a need for an electrical resistance heating element which is compatible for combing devices and will provide instantaneous heat transfer.

OBJECTS, FEATURES AND SUMMARY OF THE INVENTION

It is therefore an object of the present invention to provide a heating element that will provide maximum heat transfer and can be inexpensively manufactured.

Another object of the present invention is to provide an electrical heating element and a hair comb or pick of low production cost and high reliability and durability.

A further object of the present invention is to provide a comb or pick with a high efficiency of heat transfer from the heating element in each comb tooth to the hair while minimizing heat conduction to the backbone and handle of the comb therefore avoiding wasted energy, potential destruction or deterioration of the comb or pick, and discomfort to the user.

Further objects and features of the present invention will be apparent from the following specifications and claims when considered in connection with the accompanying drawings illustrating the preferred embodiment of the invention.

In summary, a heating element is provided comprising two elongated central conductors having a fibrous, inorganic electrical insulation yarn wound thereon thereby leaving both ends of each central conductor exposed. An electrical resistance wire is helically wound over the insulated central conductors first over one central conductor and then over the other central conductor while making electrical connection at one exposed end of each central conductor. The two insulated central conductors, wound with the one common electrical resistance wire, are mounted vertically on a flat insulator which spaces the central conductor at a predetermined distance apart to form a heating element module. A non-fibrous expandable electrical insulation sheath is placed over the electrical resistance wires of the heater module and is then coaxially disposed in the metallic tubular sheath which forms the exterior of the teeth of a comb or the like.

The non-fibrous expandable insulation sheath not only acts as a electrical insulator between the heating element and the metallic sheath, but also, when a material such as Teflon is used, the expandable sheath provides regulated heat transfer at different temperatures.

The rate of heat transfer and dissipation is therefore controlled by the rate at which the metallic sheath passes through a substance such as hair fibers. Such heating elements provide an instantaneous heat transfer when used in a device such as a comb or pick allowing the user to control the amount of heat by the rate at which the hair is combed.

In describing the preferred embodiment of the invention, specific terminology will be used for the sake of clarity. However, these terminologies are not intended to be limited to the specific terms so selected and is to be understood that each specific term includes all technical equivalents which operates in similar manner to accomplish a similar purpose.

DETAIL DESCRIPTION OF THE PREFERRED EMBODIMENT

Figure 1:
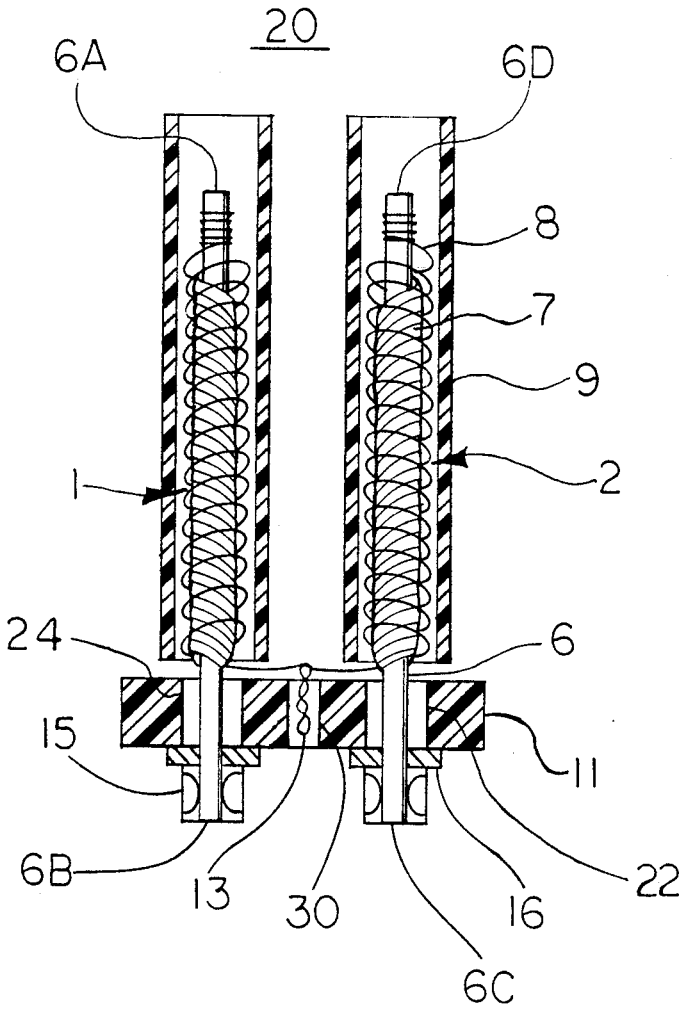
FIG. 1 is a sectional side view of a heating element module constructed according to the present invention.

FIG. 1 illustrates an electrical heating element module constructed in accordance with the present invention. It comprises two elongated central conductors 6 which form the center cores of the heating element module. Central conductors 6 are made of relatively stiff wire, preferably piano wire, of small diameter, e.g., approximately 0.015 inch in diameter.

The central conductors 6 are first insulated with a fibrous inorganic yarn 7, preferably glass yarn because glass fiber can be spun down to a very fine grade of yarn which allows the finished size of the insulated central conductor to be 0.031 inch or less to form insulated central conductors 1 and 2 and still maintain its dielectric strength. The finished size of insulated central conductors 1 and 2 must be very small to fit into a narrow cavity such as that in a comb tooth, so therefore the manufacturing process is very significant in the scope of the invention. The method of applying the fibrous inorganic electric insulation material 7 must insure that each wrap is secure, the size maintained, and the central conductors completely insulated by two single layers.

An electrical resistance wire 8 is helically wound over fibrous yarn 7 in spaced loops so that adjacent turns do not touch. Resistance wire 8 is first wound onto insulated central conductor 1 and then wound onto insulated central conductor 2 making electrical connection at exposed ends 6A and 6D but not at exposed ends 6B and 6C.

Exposed ends 6B and 6C are mounted vertically through small openings 22 and 24 in flat insulator 11 and sockets with spring contacts 15 are installed for electrical connection. Spring contacts 15 insure a good electrical connection to the exposed ends 6B and 6C regardless of the vibration or shock placed on the finished product.

A predetermined length of resistamnce wire 8 spans the gap between insulated central conductors 1 and 2 and is formed into pigtail 13. Pigtail 13 is disposed into a small opening 30 in flat electrical insulator 11 which acts as a heat sink for the small section of resistance wire 8 not wound on insulated central conductors 1 and 2 and prevents this section from overheating and breaking the circuit.

Teflon sheaths 9 are then placed over resistance wire 8 wound on insulated central conductors 1 and 2 therefore completing one heating element module 20. The heating element module 20, as shown in FIG. 1, is then installed into a pair of tubular metallic sheaths 5 which forms the exterior of a pair of adjacent comb teeth. The comb teeth 5 are held together in a straight row and at specific distances apart by metal casing 4. Therefore, one heater module 20 will heat two adjacent teeth of a hair comb or pick.

Figure 3:
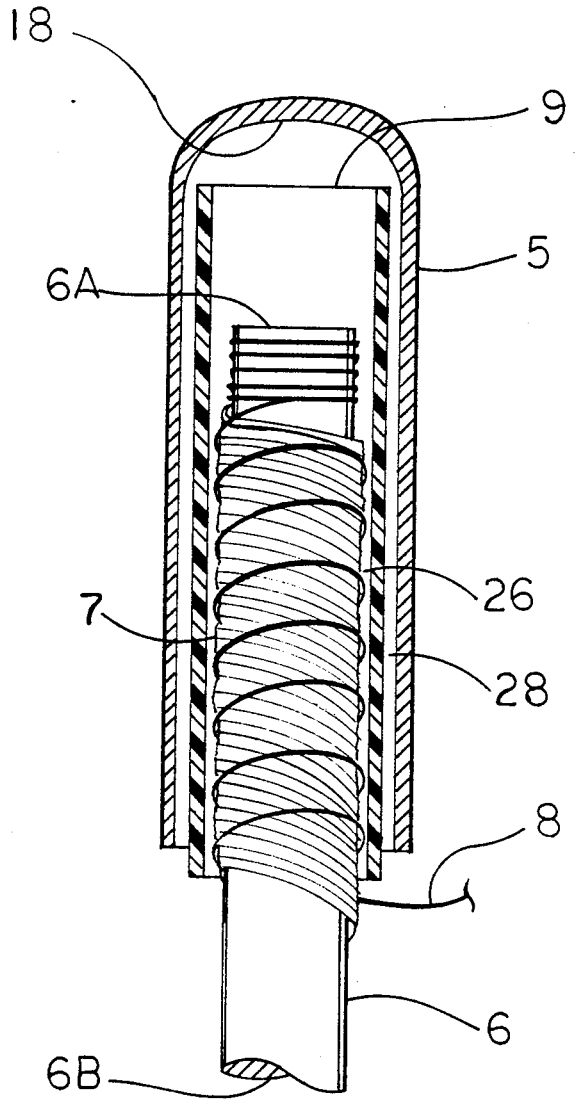
FIG. 3 is a longitudinal cross sectional view through the center of a comb tooth embodying the present invention.

Teflon sheath 9, as shown in FIG. 3, extends into each tubular metallic sheath 5 to closed end 18 and extends out of the open end of metallic sheath 5 approximately 1/16 of an inch. This totally insulates the electrical resistance heater 8 from metallic sheath 5.

As shown in FIG. 3, Teflon sheath 9 is placed over electrical resistance wire 8 but is not in contact there with, providing therein air space 26 between interior walls of Teflon sheath 9 and heater wire 8. Metallic sheath 5 is placed over Teflon sheath 9 but is not in direct contact therewith leaving air space 28 between outside wall of Teflon sheath 9 and the interior walls of metallic sheath 5.

Figure 2:
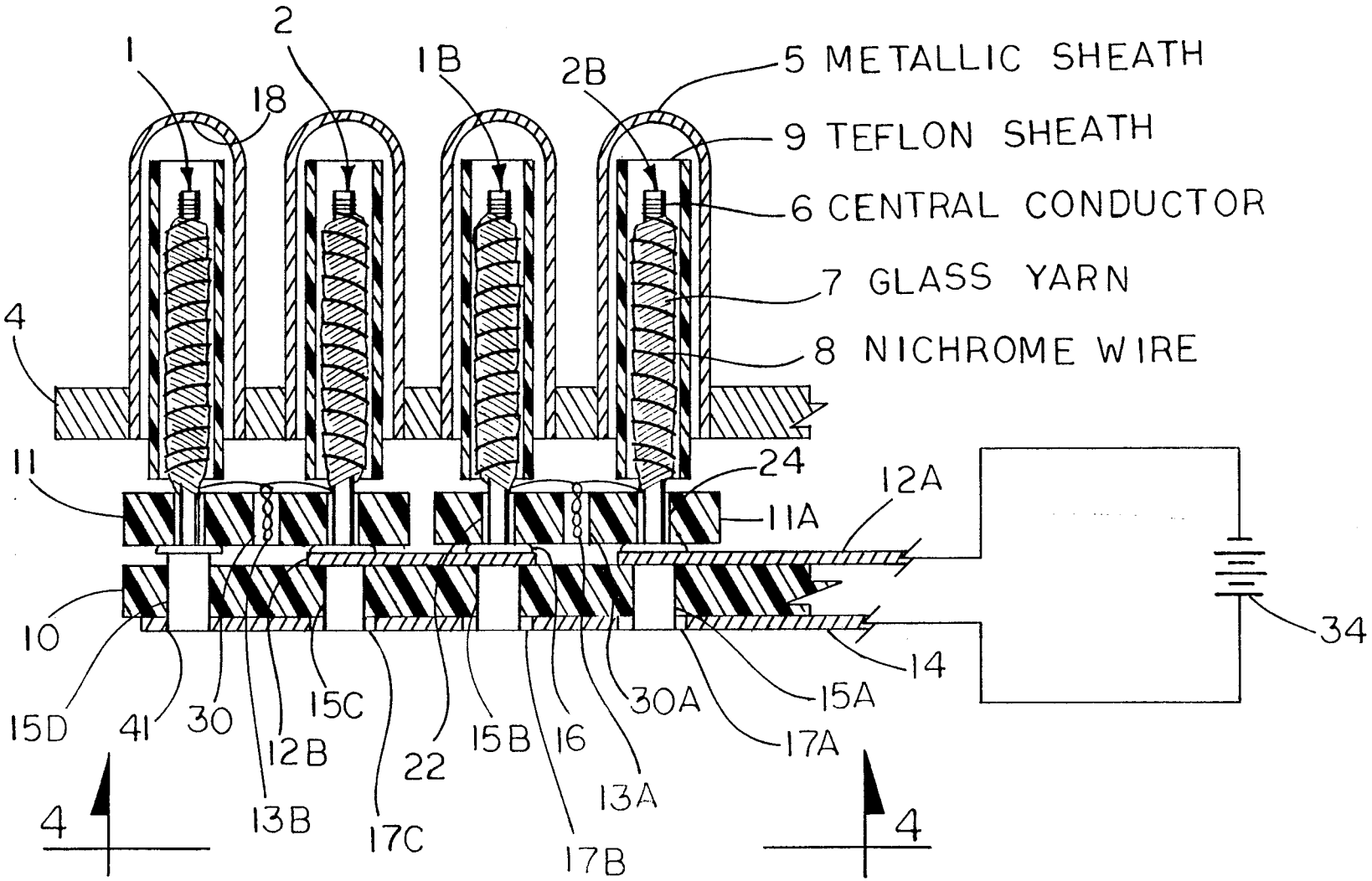
FIG. 2 is a longitudinal cross sectional view showing the details of the heating element module when used in the teeth of a comb or pick.

As shown in FIG. 2, when a hair grooming instrument embodying the present invention is connected to an electric source 34, each heating element module 20 is connected thereto by conductor jumpers. The first conductor jumper 12A fits over spring contact 15A and seats on a small lip 16 of spring contact 15A. Current flow is from power source 34 to jumper 12A to spring contact 15A and then up conductor 2B to the top of central conductor 2B. From the top of conductor 2B, current flows down through heater wire 8 to pigtail 13A and then up through the heater wire 8 to the top of conductor 1B, and then down conductor 1B to spring contact 15B and jumper 12B to spring contact 15C. This process repeats itself from spring contact 15C through central conductors 2 and 1 and heater wires 8 of the next heating element module to spring contact 15D where connection is made to conduction strip 14 at point 41 where the current is returned to the power source 34.

The conductor jumpers therefore connect the heating element modules 20 in series by connecting each central conductor 6 together via spring contact 15. A long insulator board 10 with conductor strip 14 on one side, as shown in FIGS. 2 and 4, provides the return path for the circuit.

Figure 4:
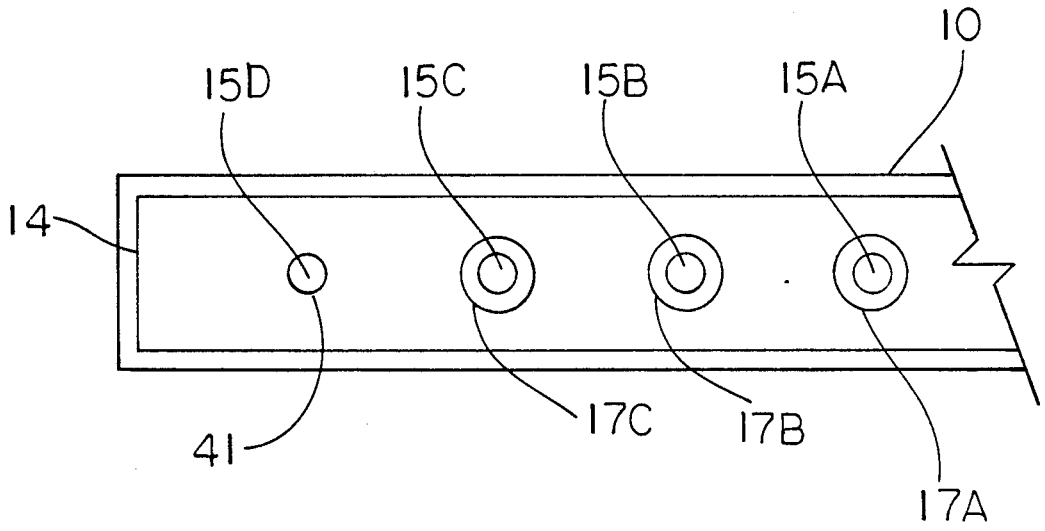
FIG. 4 is an underside view of the insulation board shown in FIG. 2.

As shown in FIG. 4, spring contact 15D makes the only connection to conduction strip 14 at point 41 because areas of conduction strip 14 are cleared away at 17C, 17B, and 17A therefore preventing electrical connection at 15C, 15B, and 15A respectively.

As shown in FIG. 2, flat insulator 11A has opening 30A which acts as a heat sink for pigtail 13A, and flat insulator 11 has opening 30 to act as a heat sink for pigtail 13B.

As various changes could be made in the described construction and methods without departing from the scope of the invention, it is intended that all matters contained herein shall be interpreted as illustrative and not in a limiting perspective.

What is claimed is:

1. An electrical heating element module for use in a comb or the like comprising:

(a) a pair of elongated metallic central conductors arranged in parallel, side-by-side spaced relationship, (b) a fibrous inorganic electrical insulation material separately wound on each of said central conductors leaving opposite ends thereof exposed, (c) a continuous electrical resistance heater wire common to said pair of insulated central conductors, said heater wire being wound first on one of said insulated central conductors and then thereafter wound onto the other of said insulated central conductors with one end of said wire being electrically connected to an exposed end of one conductor and the other end of wire being electrically connected to corresponding exposed end of the other conductor, (d) a flat electrical insulator receiving said remaining exposed ends of said insulated central conductors with said pair of conductors vertically positioned therein and said remaining exposed ends being adaptable to an electrical connection, (e) a separate tubular electrical insulation sheath of non-fibrous expandable material surrounding each of said insulated conductors and the heater wire thereon in spaced relation to said heater wire, (f) a separate metallic sheath enclosing each of said non-fibrous expandable insulation sheaths surrounding said heater wire and said insulated central conductor in spaced relationship to said non-fibrous sheath when unheated.

2. A heating element module according to claim 1 wherein said fibrous insulation material is fiberglass yarn.

3. A heating element module according to claim 1 wherein said non-fibrous electrical insulation is made of Teflon.

4. A heating element module according to claim 1 wherein said electrical resistance heater wire is made of Nichrome wire.

5. A heating element module according to claim 1 wherein said two central conductors are made of steel wire 0.015 inch in diameter.

6. A heating element module according to claim 1 wherein said remaining exposed ends of said insulated central conductors are electrically connected to a socket having a spring member.

* * * * *